US005348529A

United States Patent [19]

Veltri

[11] Patent Number: 5,348,529

[45] Date of Patent: Sep. 20, 1994

[54] ROCKING-ACTUATED MASSAGE APPARATUS

[76] Inventor: Wayne R. Veltri, P.O. Box 538, Stevensville, Mont. 59870

[21] Appl. No.: 972,996

[22] Filed: Nov. 9, 1992

Related U.S. Application Data

[63] Continuation of Ser. No. 841,835, Feb. 25, 1992, abandoned.

[51] Int. Cl.[5] ..... A61H 1/00

[52] U.S. Cl. ..... 601/99; 601/116; 297/260

[58] Field of Search ..... 297/263, 260, 272, DIG. 7; 601/99, 97, 98, 115, 116, 122, 126, 24

[56] References Cited

U.S. PATENT DOCUMENTS

| | | | |
|---|---|---|---|
| 667,085 | 1/1901 | Grader | 297/260 |
| 1,129,802 | 2/1915 | Hoard | 128/57 |
| 1,214,305 | 1/1917 | Hoard | 128/57 |
| 3,886,608 | 6/1975 | Casella | 297/260 |
| 4,686,967 | 8/1987 | Hashimoto | 128/57 |
| 4,775,184 | 10/1988 | Larkin | 297/260 |
| 5,179,940 | 1/1993 | Barreiro | 128/33 |

FOREIGN PATENT DOCUMENTS

| | | | |
|---|---|---|---|
| 2477870 | 9/1981 | France | 128/57 |

*Primary Examiner*—Robert A. Hafer
*Assistant Examiner*—David Kenealy
*Attorney, Agent, or Firm*—Harry M. Cross, Jr.

[57] ABSTRACT

This imvention is a chair comprising a seat and a backrest wherein the backrest is pivotable back and forth relative to a floor surface, the backrest being comprised of: a backrest frame extending above the seat, a massage frame mounted by the backrest frame and adapted to reciprocally-slide longitudinally of the backrest frame, massage rollers mounted by the massage frame and positioned so as to protrude beyond the backrest frame into the space occupied by a sitter's back, and a cover on the backrest frame covering the massage frame in front of the massage rollers whereby the cover will be interposed between a sitter's back and the massage rollers; and an actuating device mounted to the massage frame and being so constructed and arranged whereby pivoting movement of the backrest will effect relative movement between the massage frame and the backrest frame, thereby causing the massage rollers to move longitudinally of the backrest frame in a reciprocative manner as the backrest pivots back and forth.

11 Claims, 4 Drawing Sheets

ROCKING-ACTUATED MASSAGE APPARATUS

RELATED APPLICATION

This application is a continuation of Ser. No. 07/841,835, filed Feb. 25, 1992, now abandoned.

FIELD OF THE INVENTION

The present invention relates to the field of back massage apparatus and, more particularly, to rocking-actuated massage apparatus adapted for use on stationary and rocking chairs.

BACKGROUND OF THE INVENTION

While apparatus has been proposed for accomplishing the massage of a person's back while sitting in a chair, such apparatus is complicated and expensive. Such apparatus may use motors connected through gears, belts or chains to a movable or vibratory massage mechanism. Patents that illustrate this apparatus illustrate the general state of the art, but are not relevant to this invention.

The above disadvantages have been eliminated by the present invention which comprises self-propelled roller massage units based on the direct rocking action of the person rocking.

Another beneficial feature of the present invention is a manually hand powered rocking actuating device which is built into an interchangeable rocking chair seat for persons who are paraplegic, or a person who wants to exercise his arms and legs while enjoying a good massage.

SUMMARY OF THE INVENTION

The present invention provides a rocking-actuated massage apparatus for stationary and rocking type chairs wherein detachable massaging roller elements are disposed in backrest parts of the chair with a drive arm extending to the floor or base parts of a chair to provide massaging as a person rocks to and fro on a chair. Manual leg or hand rocking of the chair propels the reciprocating massage apparatus providing therapeutic as well as physical fitness exercising benefits. An electric motor driven crank cam may be provided as an indirect auxiliary rocking drive means.

In its broadest aspect, this invention is a chair comprising a seat and a backrest wherein the backrest is pivotable back and forth relative to a floor surface. The backrest is comprised of: backrest frame means extending above the seat, massage frame means mounted by the backrest frame means and adapted to reciprocally-slide longitudinally of the backrest frame means, massage roller means mounted by the massage frame means and positioned so as to protrude beyond the backrest frame means into the space occupied by a sitter's back, and cover means on the backrest frame means covering the massage frame means in front of said massage roller means whereby the cover means will be interposed between a sitter's back and the massage roller means. An actuating means is mounted to the massage frame means and is so constructed and arranged whereby pivoting movement of the backrest will effect relative movement between the massage frame means and the backrest frame means, thereby causing the massage roller means to move longitudinally of the backrest frame means in a reciprocative manner as the backrest pivots back and forth. The actuating means, in effects is a stabilizer that essentially maintains the absolute position of the massage roller means, relative to a floor surface, so that the back and forth pivotal movement of the backrest frame means will effect the relative movement between the massage roller means and the backrest frame means.

In operation, it would appear that the massage roller means is moving up and down the backrest frame means, as the backrest pivots back and forth. However, it is essentially the backrest frame means that is doing the moving, with the massage roller means being maintained, by the actuating means, in a relatively stable elevation with respect to the floor surface. As a stabilizer for the massage roller means, the actuating means must permit the massage roller means to move back and forth in an arc along with the backrest frame means because it, (the massage roller means), is mounted by the massage frame means to the backrest frame means and, therefore, must move along with the backrest. As a consequence of the pivotal movement of the backrest, therefore, the elevation of massage roller means will vary slightly, up and down, but the significant massaging movement is effected by movement of the backrest frame. This is readily apparent from a consideration how the structures shown in the Figures would react, relative to one another, to rocking movement of the chair backrest.

The chair of the present invention includes a massage frame mounted to the chair backrest for slidable movement thereon. This massage frame includes several rollers mounted on horizontal shafts so that the rollers can roll up and down the back of a user as the chair is rocked forwardly and backwardly. As the chair is rocked forwardly and backwardly, the massage frame moves up and down the chair backrest. This up and down motion of the massage frame causes the rollers to roll on their shafts against the user's back, thereby massaging it.

On a chair with floor rockers, a T arm extends rearwardly of the rocker and has one end rigidly attached to the slideable massage frame and has the other end attached downwardly to a wheel resting on the floor. As the chair is rocked backwardly, the T arm pushes the frame upwardly. As the chair is rocked forwardly, a spring pulls the massaging frame downwardly.

On a chair without floor rockers, rocking means to actuate the massage assembly is produced by a rocking back and forth of the backrest as it is pivotally affixed to the rear of the chair's seat. On another type of chair without floor rockers, rocking means to actuate the massage assembly is produced by a rocking back and forth of the seat and backrest rigidly combined, as they are resistively pivotally affixed from the front end of the seat to the front end base of the chair. These chairs without floor rockers have a link arm which extends to a base of the chair and is pivotally affixed at both ends. This link performs the same function as the rigidly affixed T arm on the rocking chair with floor rockers.

An electric motor propelled crank cam affixed to the chair may be provided to provide an auxiliary drive means to force the chair to rock.

The purpose of this invention is to relieve back pain and muscle strain while providing good back support for the person using the chair. Also the person can adjust with exactness the part to which he desires to massage, how firm, how large of area and the speed which is the most comfortable to him or her personally. An apron cover for the backrest and massage assembly has pockets for padding which allows a person to make more refined comfort adjustments. By placing a rubber like bottle or other padding materials within the pockets, the massage rollers roll over the padding giving a much softer massage. Hot water in the rubber bottles also provides an added soothing and therapeutic benefit.

The present invention, in a preferred embodiment, relates to a massaging rocking chair which includes a massaging frame mounted to the backrest for slidable movement thereon. This massaging frame includes several rollers mounted on horizontal shafts so that the rollers can roll up and down the back of a user as the rocking chair is rocked forwardly and backwardly. An arm extending rearwardly of the rocker has one end attached to the slidable massaging frame and has the other end attached to a roller resting on the floor. As the chair is rocked backwardly, the arm pushes the frame upwardly. As the chair is rocked forwardly, a spring pulls the massaging frame downwardly. This up and down motion of the massaging frame causes the rollers to roll on their shafts against the user's back, thereby massaging it.

DETAILED DESCRIPTION OF THE INVENTION

Figure 1:
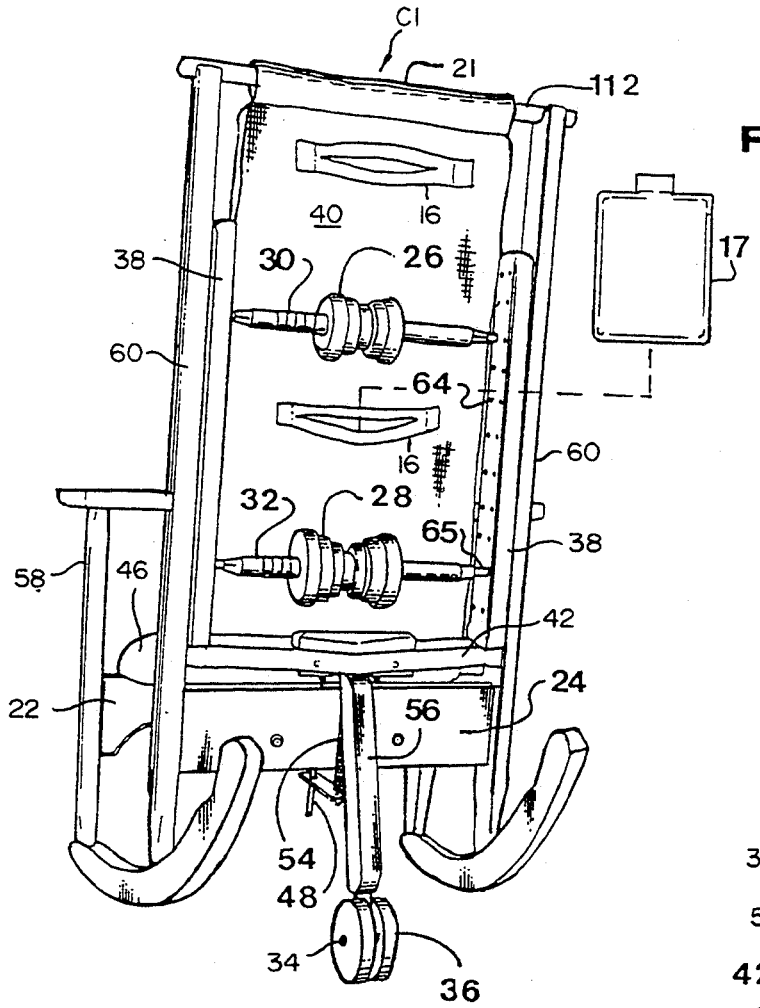
FIG. 1 is a rear view of a rocking chair showing a T arm massage roller assembly and apron covering with pockets.

Referring to the present invention wherein a rocking actuated massage apparatus is shown as used on two different types of chairs, referred to herein as: C1 to a rocking chair with rockers; and C2 to a swivel chair with the seat and backrest integrally joined and providing rocking means against a resistive swivel base. The first six Figures, FIGS. 1–6, refer to t C1 type chair, and FIGS. 7–9 refer to a C2 type chair.

Referring to the drawings wherein like numerals designate like parts throughout the several views, the illustrated massaging chair C1 of FIGS. 1–6 is provided with a seat frame 44 to which the chair framework is attached. The chair framework comprises a pair of front legs 58, a pair of rear legs 60, and a pair of rockers 18. The front and rear legs are connected by pinions at the bottom of each leg fitting into holes drilled into the rockers 18. A front cross support 22 and a rear cross support 24 are fitted into the inside of the front and rear legs, respectively. The seat frame 44 is bolted into the front and rear cross supports. A pair of chair arms 14 are provided with each arm having a hole drilled in the back of each arm and a bolt is run through the hole and then passes through an adjacent hole drilled into the adjacent rear leg and attaches to a nut. The underside front of each arm 14 has a hole drilled half way through to fit into the pinion on the top of the adjacent front leg. The various members described thus far are preferably fabricated of wood. The seat frame is generally a rectangular frame and a seat cushion 46 is securely placed thereon and screwed thereto.

A sliding back frame 12 is constructed, preferably of wood, to provide two sides 38 joined together at the lower ends to a transverse bottom support 42 to form a U-shaped frame. Each side has a grooved notch 50 running longitudinally from the top to the bottom placed in the center of the inwardly-facing face of the frame side. On the side of each leg 60 is mounted two stationary runners 52; positioned two to a side approximately 12 inches from the top of each rear leg and approximately 16 inches from the bottom of each rear leg frame. The bottom face of bottom support 42 has the top of a T-shaped iron rod 48 attached to it by two bolts, a spring 54 is hooked into an eyelet 57 at the top of the T-shaped iron rod 56 and into a flat metal plate 62. A leg of T-shaped rod 48 (in the form of a rod) extends from the frame bottom support 42 in front of the rear cross support 24 and extends below the bottom edge of rear cross support 24. Plate 62 has a hole 49 drilled through it for insertion onto the leg of rod 48 and plate 62 is adjustably mounted on the leg of rod 48 so that it can be adjusted up and down. Plate 62 extends rearwardly from its mounting on the leg of rod 48, underneath the rear cross support 24, and is provided with another hole 47 at its rearward end for attachment to the bottom hook of spring 54.

From the bottom support 42, an arm 56 (herein called a T-arm member) extends downward and rearward. Arm 56 is attached to bottom of bottom support 42 and thus appears to be the leg of a T having a U-shaped head (the U-shaped frame composed of sides 36 and transverse bottom support 42); hence the name, T-arm member. The bottom end of arm 56 is fitted with an axle 34 and two wheels 36 are mounted thereto. When the chair is assembled as shown in FIG. 1, wheels 36 rest on the floor within the confines of rockers 18 as shown. Thus, arm 56 preferably does not extend rearwardly beyond the rearward ends of rockers 18 as shown. Arm 56 and wheels 36 are also preferably constructed of wood.

The sliding back frame 12 fits between and on the inside of the rear legs 60 sliding on the stationary runners 52. As a person rocks backward, the wheels 36 (in contact with the floor) push up the sliding back frame 12 allowing the upper rollers 26 and the lower rollers 28 to message a sitter's back. The upper and lower rollers are fitted through a pair of spring loaded adjustable axles 30, 32 that are fitted into holes 64 drilled into the sliding back frame. The spring 54 is extended as a person rocks backward, and retracted when a person rocks forward. Thus, spring 54, being attached to the sliding back frame, pulls the sliding back frame 12 back down to a resting position at the top edge of the rear cross support 24 when the chair is returned to a forward position. The rollers 26, 28 are easily adjustable to fit persons of different statures or to adjust to different portions of a single user's back. The rear legs 60 extend upward beyond the seat 46 to a height sufficient to provide back support for a user, and preferably, head support also. The rear legs must extend to a height sufficient to enclose the upper ends of the moveable frame sides 38 when the chair is rocked to its backwardmost position where the moveable frame 12 will have telescoped upward to its maximum extent. Thus, the sliding back frame 12 always remains within the rear legs 60.

Figure 2:
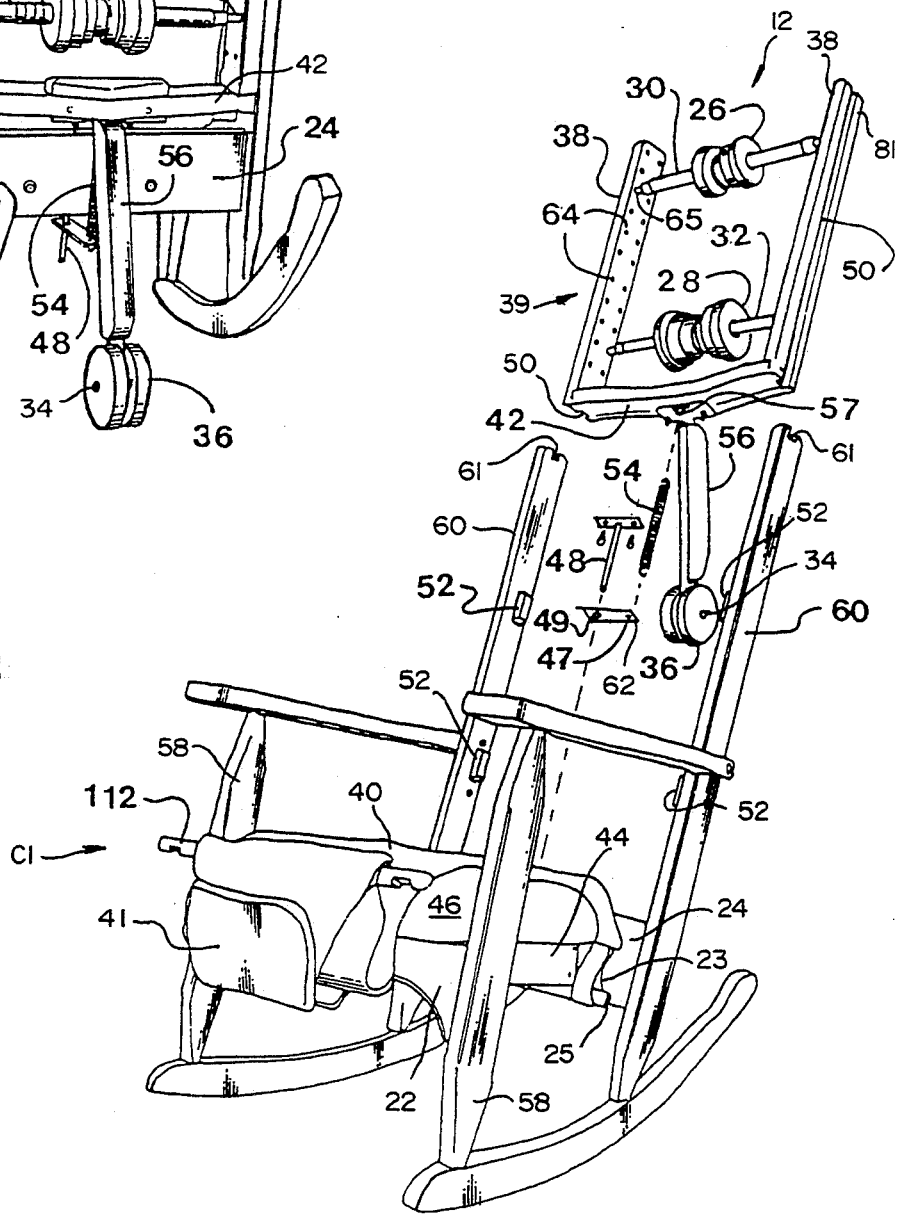
FIG. 2 shows an isometric view of a rocking chair with an expanded view of a U-shaped T arm massage roller assembly with an apron cover folded upon the seat.
Figure 3:
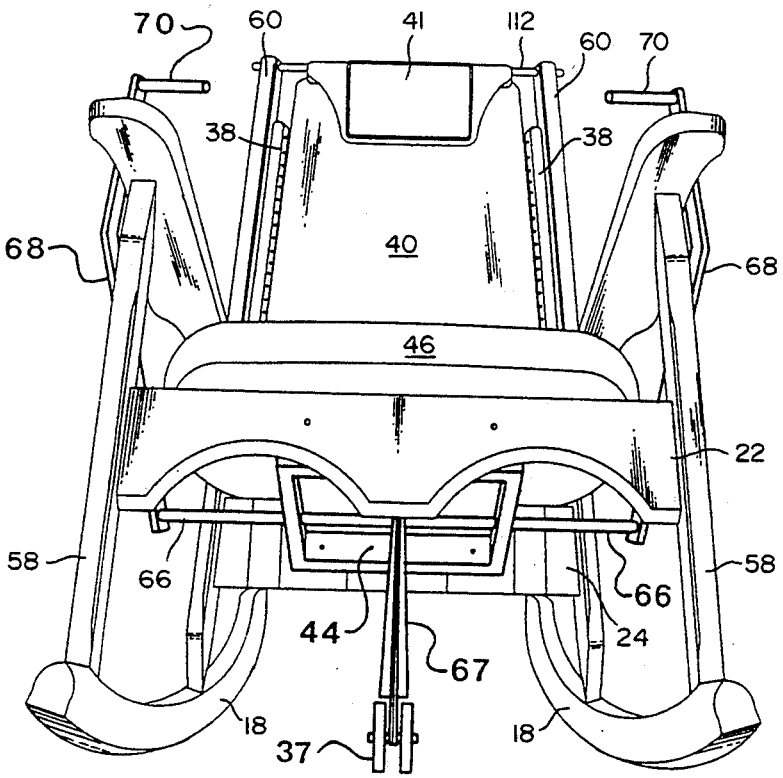
FIG. 3 is a front floor view of a rocking chair according to the present invention showing a hand drive auxiliary apparatus.

The chair frame can be fitted with a backcover 40. Backcover 40 has elastic loops 23 on the bottom in which a wood rod 25, extended under the seat frame 44, is passed through the loops 23 as shown in FIG. 2. Backcover 40 has a top loop 21 in which a rod 112 is passed through and rests on either end of the top edges of the rear legs 60 as shown in FIG. 1. The backcover 40 is provided with a headrest 41 sewn on as shown in FIG. 3 and is also provided with two pockets 26 sewn into the back thereof in such position so as to allow the rollers 26 and 28 to roll over them. These pockets 16 are made to hold one or two rubber hot water bottles, the massaging effect of the rollers 26 and 28 help massage the heat from the bottles into the user's back and upper neck area.

In FIG. 2, the cover 40 is shown draped across the seat 46 as it might be when the sliding frame 12 is installed between the chair rear legs 60. After the sliding frame 12 is installed, the rod 112 would be raised and installed in the rear leg top grooves 61, thereby raising the cover 40 into the position shown in FIG. 1. Because of the construction of the chair members, installation of the sliding back frame 12 and its cover 40 is a simple procedure. The sliding back frame 12 is completely enclosed by the chair rear legs 60 and presents an attractive, streamlined appearance. Thus, the chair as shown in FIGS. 1 and 2 is both functional and aesthetically pleasing.

Figure 4:
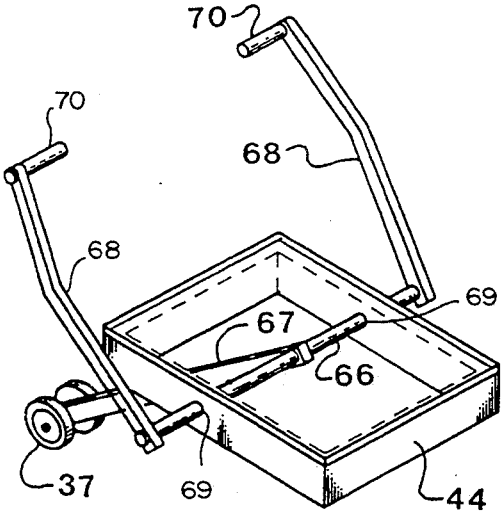
FIG. 4 is an isometric view of a rocking chair seat frame with a hand drive apparatus in place.
Figure 5:
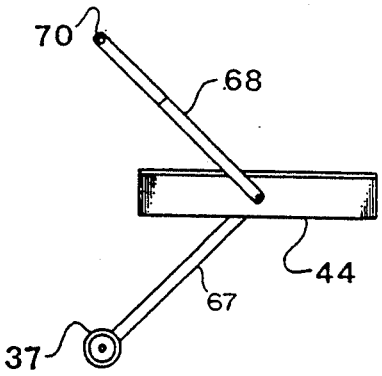
FIG. 5 is a side view of the hand drive apparatus.
Figure 6:
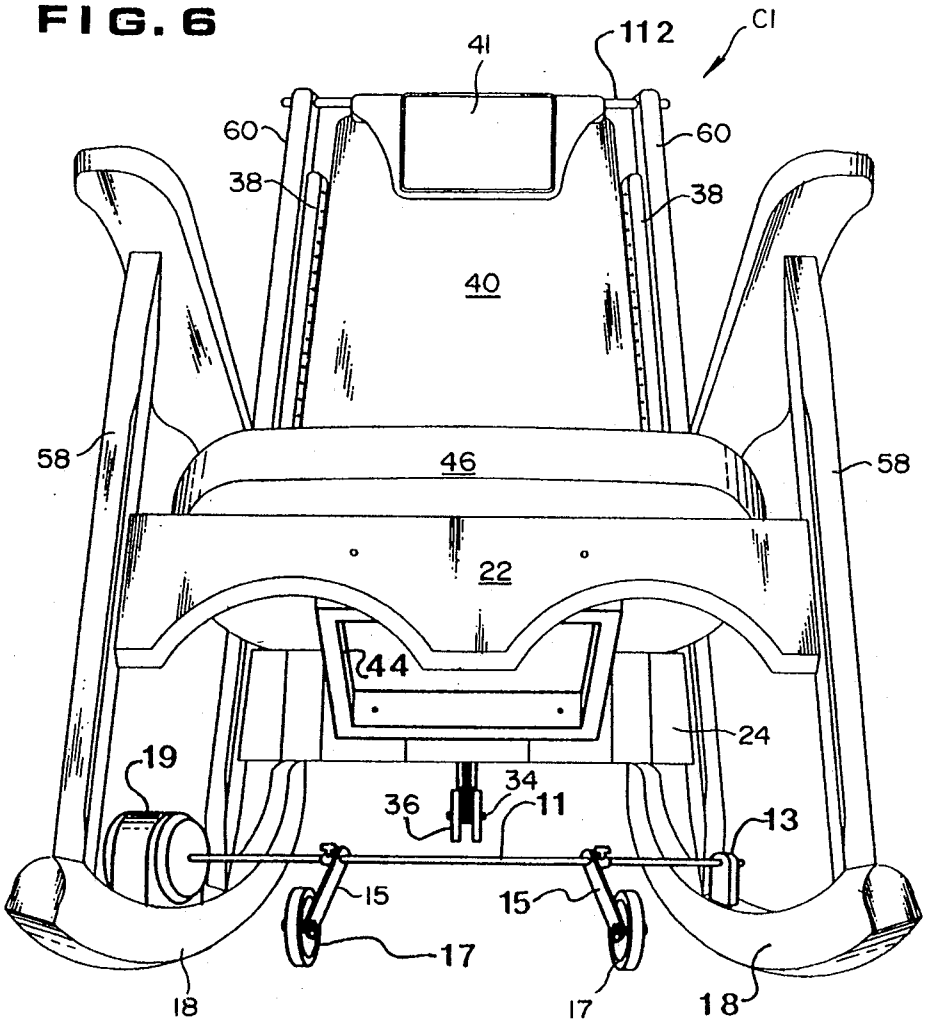
FIG. 6 is a front view of a rocking chair according to the present invention showing an electric motor drive auxiliary apparatus.

Now looking forward on to FIG. 4, it is shown that the seat frame 40 may be fitted with a horizontal shaft element 66 which continues horizontally through apertures 69 on both sides of the rectangle box seat frame 44 and two arms 68 from each outside extended ends continue upwardly and forwardly to handles 70, that are bent inwardly, parallel to the horizontal shaft element 66. At a midway point of the shaft 66, an arm, rigidly affixed, continues perpendicularly downward and forwardly to attached wheels 37 upon the floor. A person using the rocking chair C1, with the seat frame 44 so fitted, can rock the chair C1 backwardly by pushing forwardly on the handles 70, thus actuating the arm 67 and wheels 31 downwardly. As the rocking chair C1 continues in a backward motion, wheels 36, rearward of the chair C1, roll up upon the floor and drives a rigidly affixed T arm roller massage assembly 12 upward actuating massage roller 28 and 26 to roll against a persons back. The chair C1, when reaching its farthest extent of travel rearward, tensions a spring 54. As shown in FIG. 2, a spring 54 is fastened to the top of the T arm member 56 at hook 57 and continues downward attached to hole 47 on a horizontal metal plate 62, plate 62 extends forwardly to an extended end with a hold 49 therein. A vertical metal rod 48 passes through the hole 49 in metal plate 62, where metal plate 62 can be adjusted up or down to vary the spring tension needed. In FIG. 6, a variable speed electric powered motor with reduction gearing means 19 may be mounted forwardly upon a rocker arm 18 to rotate a shaft 11 transversely through bearings 13 mounted on each rocker arm 18. Two extended perpendicular cam arms 15 are rigidly affixed to shaft 11 and are extended upwardly to wheels 17 disposed thereon to push upon a floor, therefore actuating a rocking motion back and forth each time a rotation is completed.

To the rear of chair C1, FIG. 2 expanded view, we find a T bar massage roller assembly 12 slideably disposed on dovetail guide blocks 52. Assembly 12 is disposed upon the inside face of each vertical backrest support 60. Thus, support legs 60 slideably receive the assembly 12 through grooves 50 as they are routered out the full length of the outside face 81 of the U-shaped frame 39. Adjustment apertures 64 are drilled on the inside of the slide guide arms 38 of the U-shaped frame for placement of roller assemblies 26 and 28, by placing and pressing one end stem 65 into an inside hole 64. A spring 116 is depressed inside the roller shaft 30, 32, then by swinging the roller shaft 30,32, alignment of the other end stem 65 can be placed into the hole 64 on the opposite side arm 38 completing the placement of the roller assembly.

Affixed to the center bottom horizontal member 42 of the U-shaped frame 39 is a T arm 56 which runs downwardly to the floor where wheels 36 are fastened thereon. T arm roller assembly 12 is pulled downward upon the floor against a chair frame cross support member 24 by a spring 54 fastened to a hook 57 at the bottom part of the T of the T arm 56. The bottom opposite end of the spring 54 is hooked to the rear part of a rectangular metal plate 62. A metal rod 48 stems vertically downward from a back cross support 24 through a hole 49 so as to bind against metal plate 62 as spring 54 tensions upward. At the top ends of the slide guide support rear chair legs 60 is a notch 61 for a detachable apron support member 112 to rest thereon for holding, by a loop 21, an apron support cover 40. Continuing down the apron cover 40 to the lower end, rod 25 runs through loops 23 placed under cross support member 24. On the back side of the apron 40 are pockets 16 vertically disposed therein for inserting a rubber like flat bottle 17 filled with water or air, or any variety of cushioning materials.

Figure 8:
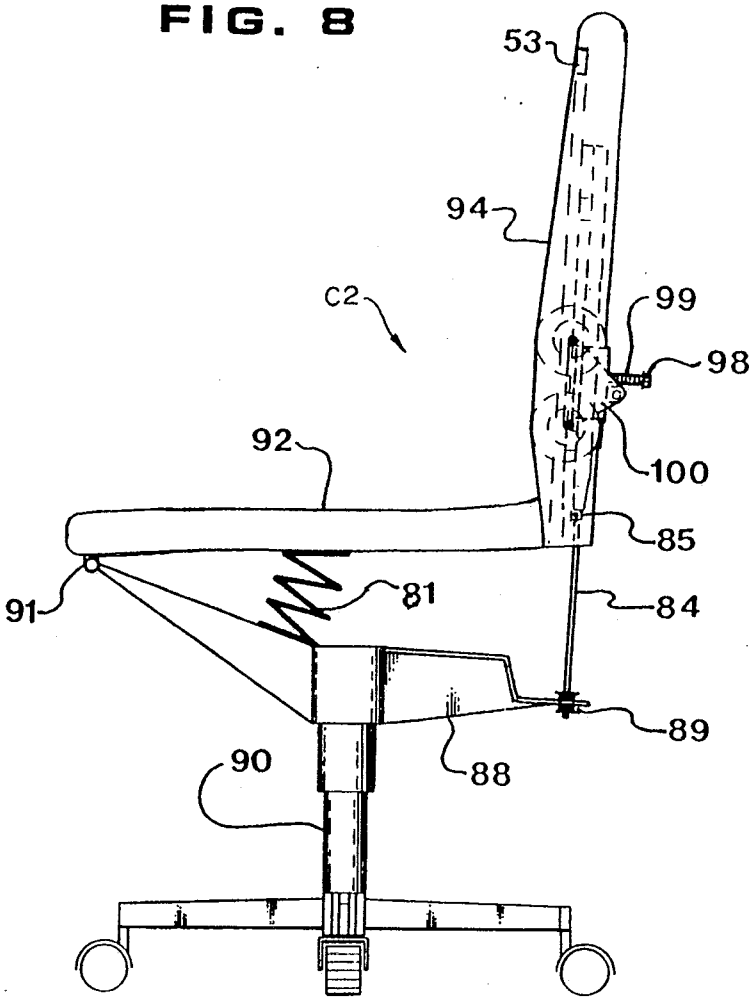
FIG. 8 is a side view of the swivel chair assembly.
Figure 9:
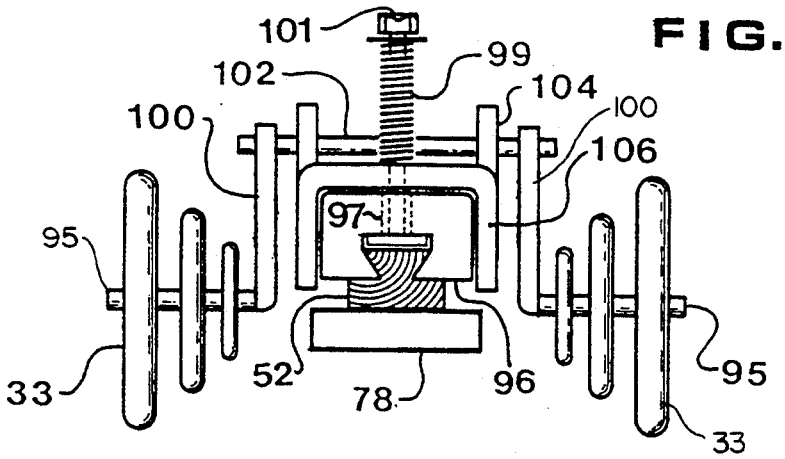
FIG. 9 is an enlarged view of the tandem bogie roller massage assembly.
Figure 7:
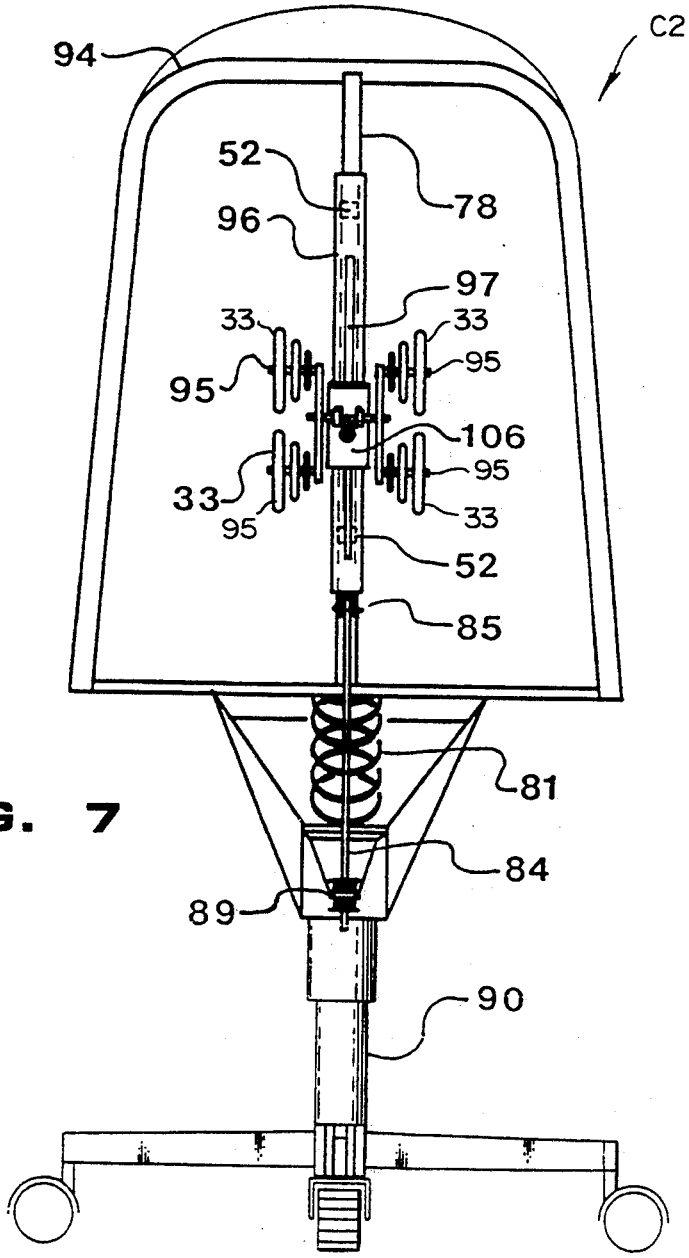
FIG. 7 is a back view of a swivel chair with a tandem bogie massage roller assembly.

Now referring to a second chair C2, FIGS. 7–9, with swivel means, the chair has a base 90, a swivel support member 88, pivotal means 91 on the forward end thereon and a protruding spar 89 on the back portion. A seat 92 and backrest 94 integrally together rock and work about a pivotal means 91 and against a compression spring 81. Compression spring 81 is positioned underneath seat 92 and upon swivel support member 88. Support member 88 swivelly holds a link arm 84 which runs vertically up to where it is swivelly joined to a dovetail grooved slidable member 96. Member 96 is slideably tracked upon track guide wedge blocks 52, which are joined integrally together on the back of a single vertical slide guide support post 78 as part of the back rest frame 94. Guide blocks 52 are disposed rearwardly outward of the back plane of the back rest frame 94 so as to allow quick and simple mounting or removal, with the only part to attach being the spring 99. On the back of the dovetail grooved slidable member 96, a U-shaped tandem bogie roller massage carriage 106 slideably sets over the back of the dovetail grooved slidable member 96 and is fictionally joined thereon by a spring 99. Bolt 101 is used to couple the dovetail slidable member to the massage roller carriage 106 through an adjustment slot 97 and a bore mid section of the said roller carriage 106. A bogie pivot axle 102 transverses the roller carriage 106 pivotally and has two rocker members 100 attached thereon to ends of the axle 102 perpendicularly to both sides of carriage 106. Rocker members 100 have stub shafts 95 perpendicularly disposed outwardly on each extended end of each rocker member 100 to fit massage rollers 33 journalled thereon. As the bogie massage roller carriage 100 rolls and massages upon a person's back the spring 99 allows the carriage 106 to roll flotationally over the contour of one's curved spine While the preferred embodiment of the invention has been described herein, variations in the design may be made. The scope of the invention, therefore, is only to be limited by the claims appended hereto.

The embodiments of the invention in which an exclusive property is claimed are defined as follows:

1. A chair comprising a seat and a backrest wherein the backrest is pivotable back and forth relative to a floor surface, the backrest being comprised of: backrest frame means extending above the seat, massage frame means mounted to and carried by said backrest frame means and adapted to reciprocally-slide longitudinally of said backrest frame means, massage roller means mounted by said massage frame means and positioned so as to protrude beyond said backrest frame means into the space occupied by a sitter's back, and cover means on said backrest frame means covering said massage frame means in front of said massage roller means whereby said cover means will be interposed between a sitter's back and said massage roller means; and actuating means mounted to said massage frame means and being so constructed and arranged whereby pivoting movement of said backrest will effect relative movement between said massage frame means and said backrest frame means, thereby causing said massage roller means to move longitudinally of said backrest frame means in a reciprocative manner as said backrest pivots back and forth; said backrest frame means comprising a pair of upright side rails extending above said seat; and said massage frame means comprises a pair of elongated side members and a bottom cross member, said side members being cooperatively constructed and arranged with respect to said side rails whereby said side members are confined to track upward and downward along said side rails, said massage roller means being mounted by said side members between said side rails; and said actuating means comprising an elongated arm member and wheel means, said arm elongated member having first and second ends with said first end being rigidly mounted to said bottom cross member and said wheel means being mounted to said second end, and said elongated arm member extending downwardly from said cross member so as to engage said wheel means with a stationary support surface, said elongated arm member and said wheel means being so constructed and arranged to maintain said wheel means in constant bearing contact with its support surface whereby the pivoting backwardly of said backrest will cause said elongated arm member to move backwardly in unison with said backrest, and will cause said wheel means to roll backwardly on its support surface so as to effect an upward movement of said massage frame means relative to said backrest.

2. The chair of claim 1 including rocker means mounting the chair seat and backrest whereby pivotable movement of said backrest is effected by rocking the chair back and forth on said rocker means; and wherein said elongated arm member is so mounted to said massage frame means and extended downwardly therefrom to the support surface whereby the pivoting backward of said backrest by the rocking of the chair will cause said wheel means to bear against its support surface to effect an upward movement of said massage frame means relative to said backrest.

3. The chair of claim 2 wherein the chair seat and backrest are fixed relative to one another whereby rocking the chair back and forth will cause the chair seat and backrest to move in unison.

4. The chair of claim 1 wherein said massage roller means comprises at least one roller set comprising a roller member and a roller shaft extending horizontally through said roller member such that said roller member is freely rotatable thereon, said roller shaft being adjustably mounted to said massage frame means whereby the position of said roller set can be adjusted vertically on said backrest.

5. The chair of claim 2 wherein said massage roller means comprises at least one roller set comprising a roller member and a roller shaft extending horizontally through said roller member such that said roller member is freely rotatable thereon, said roller shaft being adjustably mounted to said massage frame means whereby the position of said roller set can be adjusted vertically on said backrest.

6. The chair of claim 1 including guide member means mounted on one of said pair of backrest frame side rails and said pair of massage frame side members, the other of said pair of side rails and said pair of side members being cooperatively constructed to fit on said guide member means whereby said massage frame means may move upwardly and downwardly of said side rails.

7. The chair of claim 3 including guide members means mounted on one of said pair of backrest frame side rails and said pair of massage frame side members, the other of said pair of side rails and said pair of side members being cooperatively constructed to fit on said guide member means whereby said massage frame may move upwardly and downwardly of said side rails.

8. The chair of claim 6 wherein said massage roller means comprises at least one roller set comprising a roller member and a roller shaft extending horizontally through said roller member such that said roller member is freely rotatable thereon, said roller shaft being adjustably mounted to said backrest frame side members and extended therebetween whereby the position of said roller set can be adjusted vertically on said backrest.

9. The chair of claim 7 wherein said massage roller means comprises at least one roller set comprising a roller member and a roller shaft extending horizontally through said roller member such that said roller member is freely rotatable thereon, said roller shaft being adjustably mounted to said backrest frame side members and extended therebetween whereby the position of said roller set can be adjusted vertically on said backrest.

10. The chair of claim 1 wherein said cover means includes a pocket for holding a cushioning object, said pocket being positioned relative to said massage roller means whereby said roller means will traverse said pocket as relative movement occurs between said massage frame means and said backrest frame means.

11. The chair of claim 4 wherein said cover means includes a pocket for holding a cushioning object, said pocket being positioned relative to said massage roller member whereby said roller member will traverse said pocket as relative movement occurs between said massage frame means and said backrest frame means.

* * * * *